US007425057B2

(12) United States Patent
Harada et al.

(10) Patent No.: US 7,425,057 B2
(45) Date of Patent: Sep. 16, 2008

(54) LIQUID DISCHARGE HEAD AND METHOD FOR MANUFACTURING THE SAME

(75) Inventors: Kouji Harada, Tokyo (JP); Isao Imamura, Kanagawa (JP); Hikaru Ueda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 11/390,457

(22) Filed: Mar. 28, 2006

(65) Prior Publication Data

US 2006/0221133 A1 Oct. 5, 2006

(30) Foreign Application Priority Data

Apr. 4, 2005 (JP) ..... 2005-107646

(51) Int. Cl.
*B41J 2/05* (2006.01)

(52) U.S. Cl. ..... 347/58; 347/50; 347/59

(58) Field of Classification Search ..... 347/50, 347/58, 59, 63, 67, 72
See application file for complete search history.

(56) References Cited

U.S. PATENT DOCUMENTS

| | | | |
|---|---|---|---|
| 5,763,141 | A | 6/1998 | Shimomura et al. |
| 6,123,863 | A | 9/2000 | Shimomura et al. |
| 6,241,340 | B1 | 6/2001 | Watanabe et al. |
| 6,318,842 | B1 | 11/2001 | Shimomura et al. |
| 6,609,782 | B2 | 8/2003 | Mori |
| 6,793,326 | B2 | 9/2004 | Imamura et al. |
| 6,895,668 | B2 | 5/2005 | Imamura |
| 2002/0003556 | A1 | 1/2002 | Mori |
| 2005/0078143 | A1 | 4/2005 | Shimomira et al. |
| 2006/0230614 | A1 | 10/2006 | Imamura et al. |

FOREIGN PATENT DOCUMENTS

| | | |
|---|---|---|
| JP | 10-44418 | 2/1998 |
| JP | 2002-19120 | 1/2002 |

OTHER PUBLICATIONS

Note: Counterpart U.S. patent document(s) also cited (see text of IDS).

*Primary Examiner*—Lam S Nguyen
(74) *Attorney, Agent, or Firm*—Fitzpatrick, Cella, Harper & Scinto

(57) ABSTRACT

A liquid discharge head including a discharge element substrate including an orifice plate having a discharge port for discharging a liquid, and a supply port opened in the reverse side of the surface forming the discharge port for supplying a liquid into the discharge port; a support member having a supply path for supplying a liquid into the supply port; and a flexible wiring substrate having a blanking portion for transmitting a signal for discharging a liquid to the discharge element substrate. The discharge element substrate is electrically connected to the flexible wiring substrate on the surface opening the supply port, the flexible wiring substrate is bonded to both the discharge element substrate and the support member by means of an adhesive, the end face of the blanking portion is covered with the adhesive, the covered blanking portion communicates with the supply port, and the adhesive is a thermally fusible adhesive composed of denatured polyolefin, having a softening point of 80° C. or higher.

6 Claims, 4 Drawing Sheets

LIQUID DISCHARGE HEAD AND METHOD FOR MANUFACTURING THE SAME

BACKGROUND OF THE INVENTION

1. Field of the Invention

The invention relates to a liquid discharge head, and more particularly to an ink jet recording head for recording by discharging a recording liquid into a recording medium, and a method for manufacturing the same.

2. Related Background Art

Conventionally, a flexible wiring substrate used as electric circuit substrate is composed of, for example, base film of polyimide resin or the like, a wiring layer of copper foil or the like, cover coat material of polyimide resin or thin film resist material, and adhesive for bonding them. This flexible wiring substrate is a thin and flexible substrate, and is blanked and formed by using die, laser, drill or other means, and is used in various parts in personal computer, ink jet recording apparatus or the like.

The flexible wiring substrate is often fixed and bonded to a product such as a support member or the like. For example, it is preferably used as an electric wiring member for a liquid discharge head. When used in the ink jet recording head as a typical application example of a liquid discharge head, the flexible wiring substrate may be peeled or swollen, depending on the type of the ink, due to mist caused by ink discharge or the like, and elution by ink may be possibly induced. Accordingly, it has been proposed to protect the end face of a blanking part (blanking end face) of the flexible wiring substrate by using a sealing agent.

Japanese Patent Application Laid-Open Nos. H10-044418 and 2002-19120 disclose an ink jet recording head protecting the blanking part end face of the flexible wiring substrate as shown in FIG. 1. More specifically, thermosetting adhesive or sealing agent made of epoxy resin or the like is used for covering electrical connection parts of the flexible wiring substrate and the discharge element substrate, and blanking end face of the flexible wiring substrate.

FIG. 2 is a diagram of flexible wiring substrate near electrical connection parts bonded to the support member of the ink jet recording head by thermosetting adhesive of epoxy resin or the like. FIG. 2 corresponds to magnified view near electrical connection parts in section 2-2 of the ink jet recording head in FIG. 1. Referring to FIG. 2, a discharge element substrate 101 has an orifice plate 106 including a discharge port 105 for discharging ink, and an electrode 107, and this electrode 107 and an electrode 108 of flexible wiring substrate 102 are electrically connected with each other. The discharge element substrate 101 is fixed to a support member 103 by means of an adhesive A111.

In the prior art shown in FIG. 2, first, the flexible wiring substrate 102 is formed into a desired shape by blanking by using a die. Next, a thermosetting adhesive B112 of epoxy resin or the like is transferred by a transfer plate on a predetermined position on the support member 103 to which the discharge element substrate 101 is bonded. By compressing and heating the flexible wiring substrate 102, the flexible wiring substrate 102 and the support member 103 are bonded by thermal compression. Further, a thermosetting sealing agent 110 of epoxy resin or the like is injected from a syringe into the electrical connection parts of the discharge element substrate 101 and flexible wiring substrate 102. By curing in an electric furnace, the blanking end face and electrical connection parts of the flexible wiring substrate 102 are coated.

SUMMARY OF THE INVENTION

Recently, however, in a more complicated structure of the ink jet recording head, it may be often difficult to mount by the methods of patent documents 1 and 2. For example, on the reverse side of the surface having the orifice plate 238 of the discharge element substrate 210 shown in FIG. 3, it is difficult to connect electrically the flexible wiring substrate 230 and the discharge element substrate. In the electrical connection example in FIG. 3, sealing of flexible wiring substrate 230 and blanking end face 235 must be operated on the reverse side of the orifice plate 238 of the discharge element substrate 210. At the same time, the flexible wiring substrate 230 must be bonded to both the discharge element substrate 210 and the support member 220. In this case, by the injection method described above, sufficient covering precision by the adhesive may not be achieved. Specifically, the adhesive is liquid before curing, and may droop or spread, and when mounting on the reverse side of the discharge element substrate, it may be difficult to adjust the coating shape precisely in the sealing region.

The inventors made various studies to optimize the covering state by sealing of blanking end face of the flexible wiring substrate. As a result, it is decided to use a thermally fusible adhesive because it is solid at the time of mounting.

The thermally fusible adhesive is mainly composed of thermoplastic resin. The ink jet recording head is usually driven by an electrical signal, and therefore heat is generated from the discharge element substrate during use. In particular, if a heat generating resistance element is used in an energy generating element as means for obtaining discharge energy, the temperature of the discharge element substrate may reach as high as about 80° C. in usual discharge. Hence, when using a thermoplastic resin in the adhesive used for mounting of the ink jet recording head, the problem of adhesion reliability has been known.

At the same time, in the structure shown in FIG. 3, the blanking surface 235 of flexible wiring substrate often abuts against the ink path, and materials used in the adhesive and sealing agent are demanded to have not only enough adhesion but also a strong resistance to ink.

The present invention has been achieved in order to solve the above problems. It is an object of this invention to provide an ink jet recording head optimized in adhesion and covering state of blanking end face of flexible wiring substrate, being mounted by an adhesive excellent in heat resistance and ink resistance.

The invention provides a liquid discharge head comprising: a discharge element substrate including an orifice plate having a discharge port for discharging a liquid, and a supply port opened in the reverse side of the surface forming the discharge port for supplying a liquid into the discharge port; a support member having a supply path for supplying a liquid into the supply port; and a flexible wiring substrate having a blanking portion for transmitting a signal for discharging a liquid to the discharge element substrate, wherein the discharge element substrate is electrically connected to the flexible wiring substrate on the surface opening the supply port, the flexible wiring substrate is bonded to both the discharge element substrate and the support member by means of an adhesive, the end face of the blanking portion is covered with the adhesive, the covered blanking portion communicates with the supply port, and the adhesive is a thermally fusible adhesive composed of denatured polyolefin, having a softening point of 80° C. or higher.

The invention also provides a method for manufacturing a liquid discharge head comprising a discharge element substrate including an orifice plate having a discharge port for discharging a liquid, and a supply port opened in the reverse side of the surface forming the discharge port for supplying a liquid into the discharge port, a support member having a supply path for supplying a liquid into the supply port, and a flexible wiring substrate having a blanking portion for transmitting a signal for driving an energy generating element, the method comprising: a step of laminating the flexible wiring substrate having a thermally fusible adhesive made of polyolefin or denatured polyolefin, having a softening point of 80° C. or higher, on the support member; a step of laminating the discharge element substrate on the flexible wiring substrate so that the blanking portion and the supply port may communicate with each other; and a step of heating the adhesive, bonding the flexible wiring substrate to both the support member and the discharge element substrate, and covering the end face of blanking portion with the adhesive.

The invention is applied in bonding and sealing of a flexible wiring substrate with another member, and increasing the adhesion strength of polyolefin excellent in chemical resistance with a metal member. Since the thermally fusible adhesive is a thermoplastic resin, it is fused by heating and is instantly bonded to various members, and complicated components of the ink jet recording head can be mounted precisely. Besides, since the thermally fusible adhesive having excellent heat resistance in spite of thermoplastic property is used, the reliability when used in products is superior.

DETAILED DESCRIPTION OF THE PREFERRED EMBODIMENTS

Figure 1:
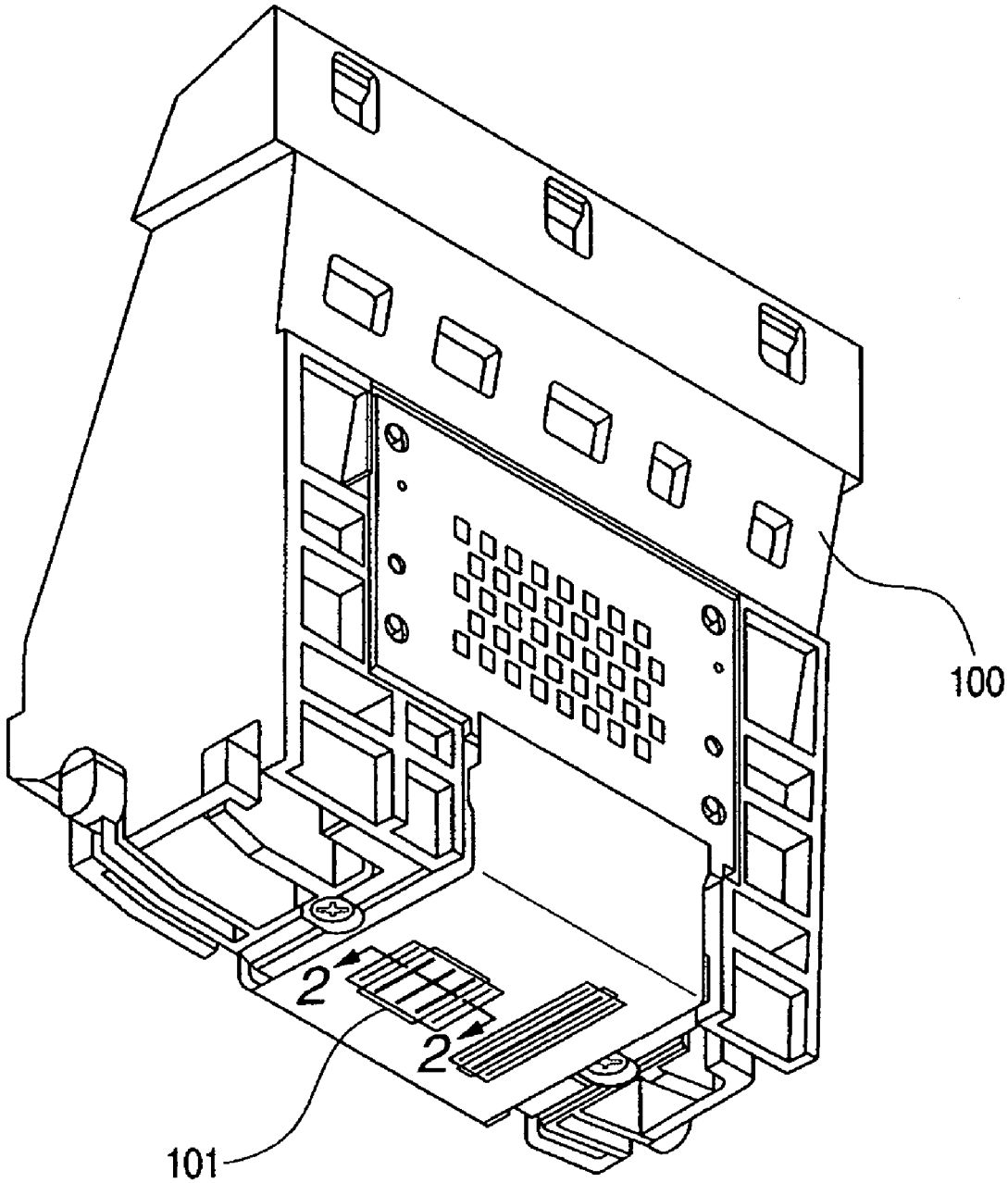
FIG. 1 is a perspective outline view of one embodiment of an ink jet recording head.
Figure 2:
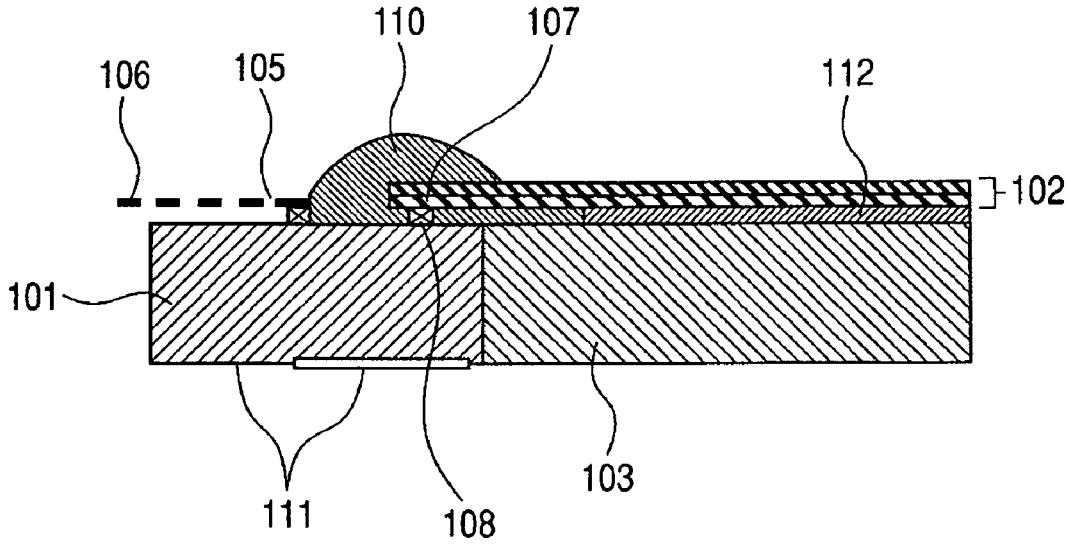
FIG. 2 is a magnified sectional view near electrical connection parts along line 2-2 in FIG. 1, showing the junction state of a flexible wiring substrate in the ink jet recording head in prior art.
Figure 3:
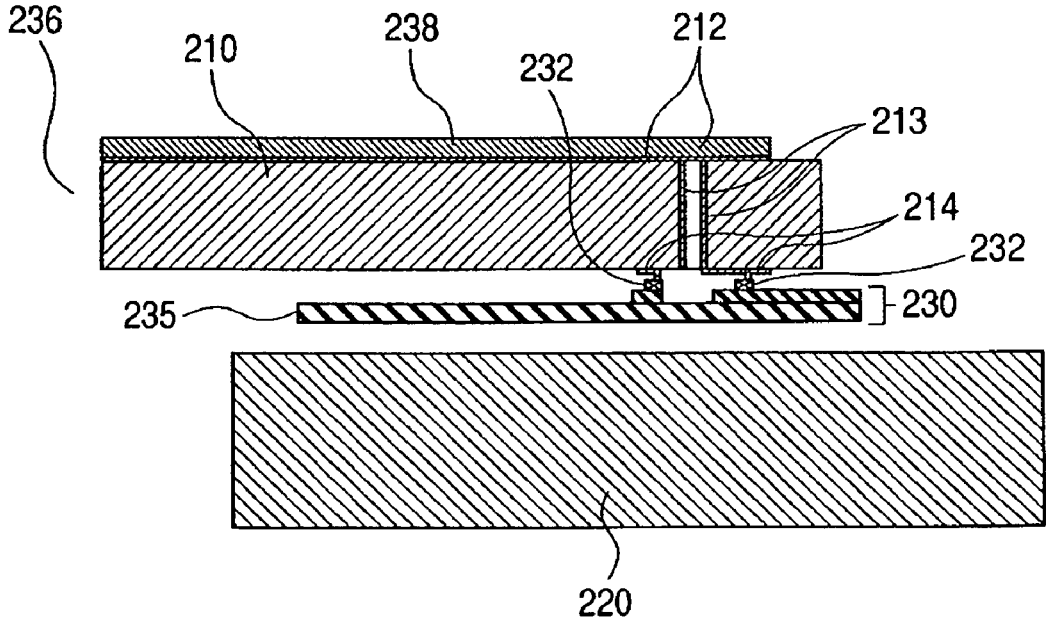
FIG. 3 is a schematic sectional view showing a junction example of the flexible wiring substrate in the ink jet recording head.

Referring now to the drawings, preferred embodiments of the invention are described specifically below. In the following description, same parts having same functions are identified with same reference numerals, and the detailed description may be not repeated.

The following description relates to an ink jet recording head, but the invention may be applied to any liquid discharge head using flexible wiring substrate, and is not limited to the ink jet recording head. For example, it is applicable in manufacture of bio chip, electronic printed circuit, a liquid discharge head for medical use for discharging chemical solution, etc.

Figure 4:
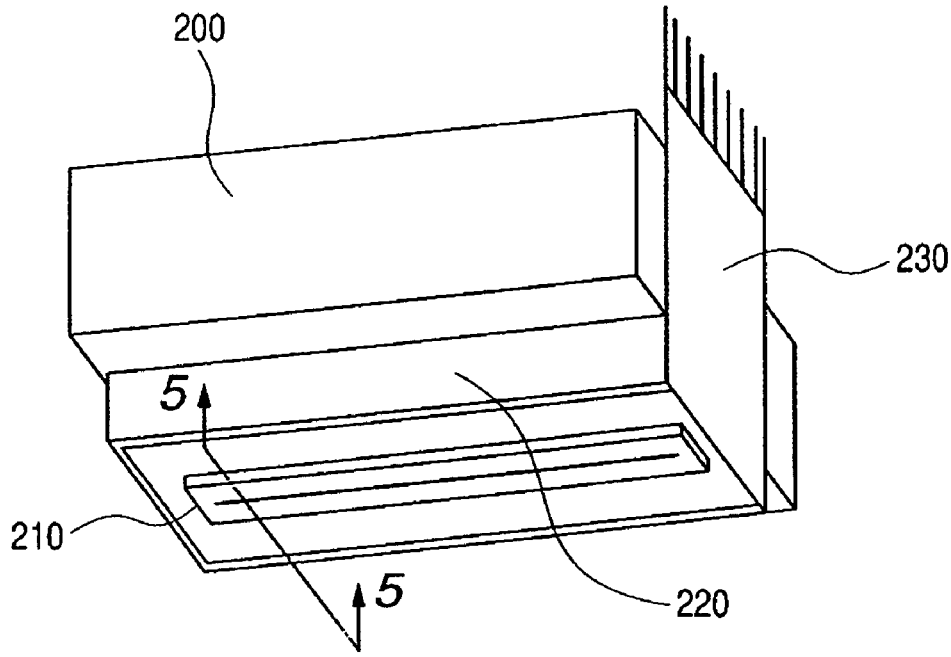
FIG. 4 is a perspective outline view of an example of the ink jet recording head in one embodiment of the invention.

FIG. 4 is a perspective outline view showing a first embodiment of the ink jet recording head of the invention. Referring to FIG. 4, the ink jet recording head of the invention includes a support member 220, a discharge element substrate 210, and a flexible wiring substrate 230.

Figure 5:
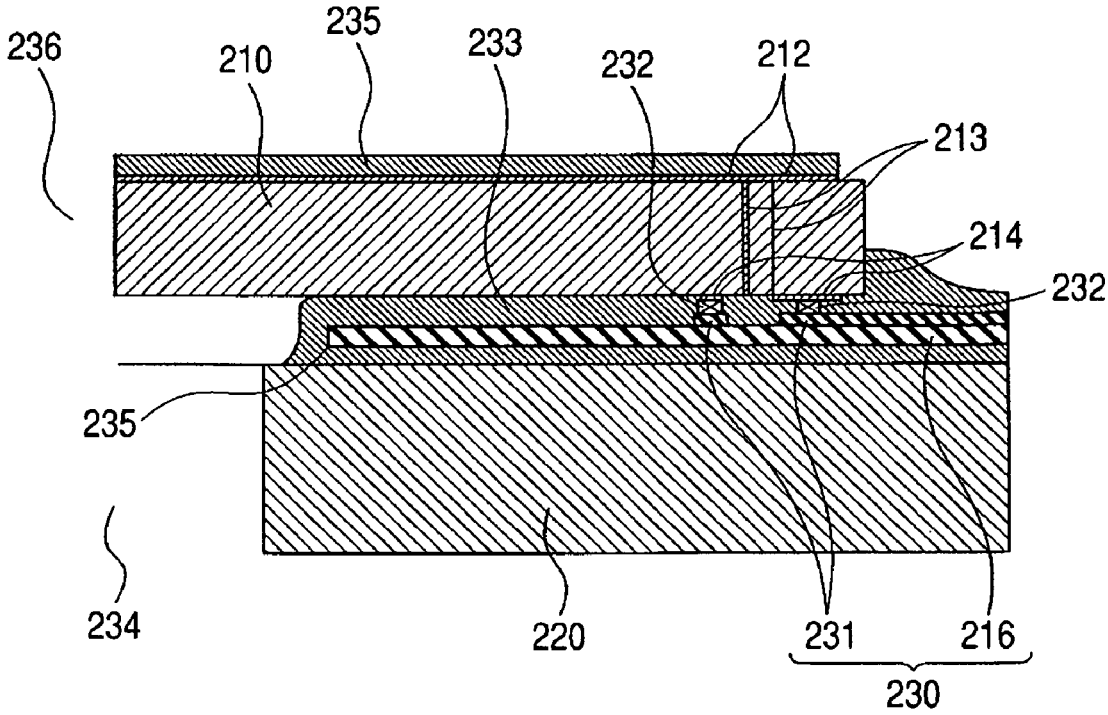
FIG. 5 is a schematic sectional view along line 5-5 in FIG. 4 of a liquid discharge head in one embodiment of the invention.

Referring now to FIG. 5, a constitution of the first embodiment of the ink jet recording head of the invention is specifically below.

FIG. 5 is a magnified view near electrical connection parts in section 5-5 in FIG. 4.

In FIG. 4, the ink jet recording head 200 has the discharge element substrate 210, which includes the discharge port and the energy generating element (not shown) used for discharging ink provided on the surface, and an electrode 212 for transmitting an electrical signal provided at the end face. From the electrode 212, a penetration wiring 213 penetrating through the discharge element substrate 210 is provided, and is connected to a back electrode 214 connected to the reverse side of the discharge element substrate 210. Beneath the discharge element substrate 210, the flexible wiring substrate 230 having a wiring layer 231 is disposed. Bumps 232 are formed on the electrode terminals formed by the wiring layer 231 on the upside of flexible wiring substrate 230. The discharge element substrate 210 and flexible wiring substrate 230 are provided on the support member 220, and are bonded to the wiring layer at the lower side of the support member 220 and flexible wiring substrate 230 by means of an adhesive 233. The supply port of the discharge element substrate 210 is formed to communicate with the supply port 234 of the support member 220 by matching with the hole formed in the flexible wiring substrate 236 by blanking in the central line. The adhesive 233 for bonding the flexible wiring substrate 230 to the support member 220 is a thermally fusible adhesive composed of denatured polyolefin. At the same time, the blanking end face 235 at the end face of the liquid supply port 234 side of the flexible wiring substrate 230 is covered and sealed so as to be completely isolated from the liquid.

When the thermally fusible adhesive 233 is melted by heat generated from the ink jet recording head at the time of recording, the adhesion strength is extremely lowered, fixing of flexible substrate may be insufficient, or the shape of blanking end face 235 may be disturbed. To prevent such inconvenience, the thermally fusible adhesive 233 used in the ink jet recording head of the invention is required to have a softening point higher than 80° C., that is, the highest temperature reached during normal use of the ink jet recording head.

[Blanking Process of Flexible Wiring Substrate]

The flexible wiring substrate used in the ink jet recording head of the invention is formed by providing a thermally fusible adhesive layer mainly composed of polyolefin on the flexible wiring substrate, and blanking into a desired shape by using a die.

Not to mention, the blanking process of the flexible wiring substrate is not limited to this process, as long as a desired fusible adhesive layer is formed on the flexible wiring substrate, or after blanking the flexible wiring substrate, a thermally fusible adhesive layer may be formed.

On the flexible wiring substrate, a thermally fusible adhesive layer may be formed only on a necessary side, either one side or both sides as required.

[Bonding and Sealing Process of Flexible Wiring Substrate]

Figure 6A:
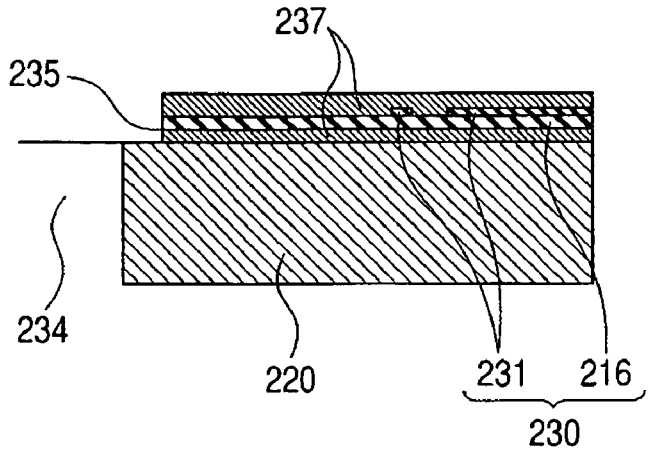
FIGS. 6A, 6B, and 6C are schematic sectional views showing a method for manufacturing a liquid discharge head in one embodiment of the invention.
Figure 6B:
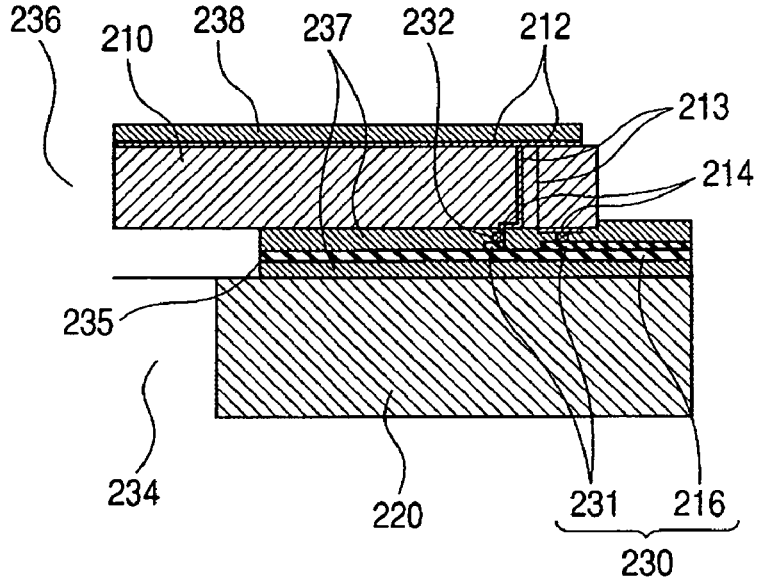
Figure 6C:
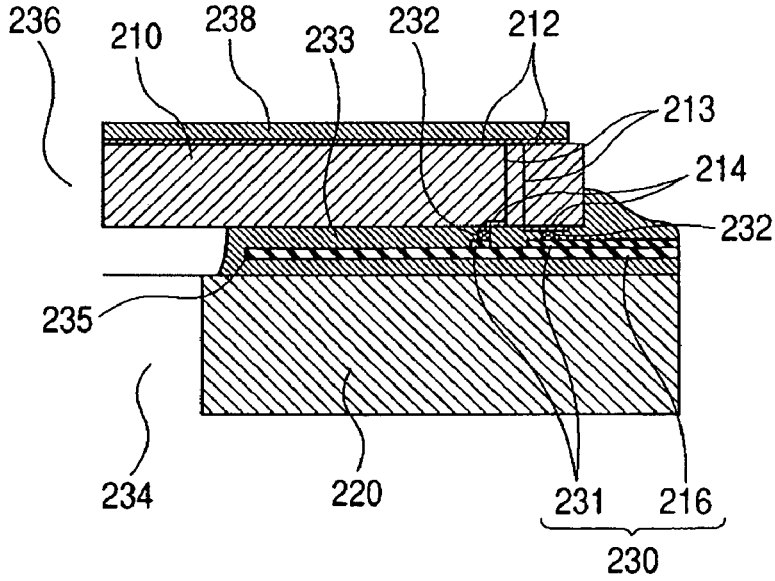

Referring to FIGS. 6A, 6B, and 6C, a method for manufacturing a liquid discharge head is explained as a second embodiment of the invention.

As shown in FIG. 6A, at a predetermined position of the support member 220, a flexible wiring substrate 230 forming a thermally fusible adhesive layer 237 is disposed.

Next, as shown in FIG. 6B, a discharge element substrate 210 is disposed at a position penetrating through a supply port 236 and a liquid supply port 234.

Then, as shown in FIG. 6C, an electrical connection is achieved by applying ultrasonic wave while being heated, both upper and lower sides are heated by heat tool. By thermal fusion, the flexible wiring substrate 230 and the discharge element substrate 210 are bonded, and the flexible wiring substrate 230 and the support member 220 are bonded simultaneously, and the blanking end face 235 of the flexible wiring substrate 230 exposed on the liquid supply port 234 is covered. At this time, if the orifice plate 238 provided in the discharge element substrate 210 is formed of cured matter of resin composition such as negative photosensitive resin, curing of the cured matter may be further promoted by heating from the heat tool. As a result, the discharge port may be deformed, and the discharge performance may be lowered. Accordingly, heating from the heat tool is suppressed at a relatively low temperature in consideration of effects on the orifice plate. For example, if the orifice plate is formed of a cured matter of resin composition, heating from the heat tool is preferred to be lower than the curing temperature of the resin composition, and at a nearly same temperature, the heating temperature should be as short as possible. Accordingly, the thermally fusible adhesive layer 237 is preferably made of a material of which softening point is lower than the curing temperature.

In the subsequent process, the covering end face of the flexible substrate 230 is sealed precisely without allowing liquid drooping.

Components of the thermally fusible adhesive used in the invention are described below.

In the invention, the thermally fusible adhesive is mainly composed of polyolefin. As the polyolefin, from the viewpoint of adhesion and chemical resistance, polyethylene, polypropylene, or their denatured compounds are used preferably, from the viewpoint of adhesion and chemical resistance. To assure the adhesion of polyolefin, denaturing agent or various additives may be used.

Specific examples of polyolefin as main ingredient include the following.

For example, low density polyethylene (LDPE); various straight chain high density polyethylene (HDPE), polypropylene, or medium density polyethylene (MDPE) manufactured by vapor phase method, solution method, liquid phase slurry method, or the like by using Ziegler catalyst, Phillips catalyst, or methalocene catalyst; linear low density polyethylene (LLDPE), very low density polyethylene (VLDPE, ULDPE); ethylene-α-olefin copolymer such as ethylene-propylene random copolymer, or block copolymer, low crystallinity ethylene-butene-1 random copolymer (EBM).

Examples of α-olefin of ethylene-α-olefin copolymer include 1-butene, 1-hexene, 4-methyl-1-pentene, 1-octyl, 1-decene, etc.

Specific examples of modifiers for denaturing polyolefin include the following.

Unsaturated carboxylic acid, unsaturated carboxylic acid anhydride and its derivatives (for example, (meth)acrylic acid, maleic acid, fumaric acid, itaconic acid, citraconic acid, or their anhydrides or derivatives such as amide, imide or ester); polymerizable unsaturated compound containing hydroxy group such as hydroxyalkyl (meth)acrylate; polymerizable unsaturated compound containing epoxy group such as 1-vinyl-3,4-epoxy cyclohexene, 3,4-epoxy cyclohexyl methyl (meth)acrylate; polymerizable unsaturated compound containing isocyanate group such as isocyanate denatured (meth)acrylate; polymerizable unsaturated compound containing silane such as vinyl trimethoxy silane, vinyl triethoxy silane.

These modifiers may be copolymerized at the time of manufacture of polyolefin, or graft-polymerized in polyolefin.

Additives include binder, silane coupling agent, and other polymers.

The binder includes, for example, petroleum resin, rosin resin, terpene resin, or their hydrates. Specific examples of petroleum resin include aliphatic petroleum resin, aromatic petroleum resin, their copolymers and hydrates. Specific examples of rosin resin include natural rosin, polymer rosin, and their derivatives (for example, pentaerythritoester rosin, glycerin ester rosin, and their hydrates). Specific examples of terpene resin include polyterpene resin, terpene phenol resin, and their hydrates.

The silane coupling agent includes, for example, vinyl silane, acrylic silane, epoxy silane, mercapto silane, amino silane, methyl silane, chloro silane, and phenyl silane. Specific examples of vinyl silane include vinyl trichlor silane, vinyl trimethoxy silane, and vinyl triethoxy silane. Specific examples of acrylic silane include γ-methacryloxy propyl trimethoxy silane, and γ-methacryloxy propyl tris (β-methoxy ethoxy) silane. Specific examples of epoxy silane include β-glycidoxy propyl trimethoxy silane. Specific examples of mercapto silane include γ-mercaptopropyl trimethoxy silane. Specific examples of amino silane include γ-amino propyl trimethoxy silane, and γ-amino propyl triethoxy silane. Specific examples of methyl silane include methyl trimethoxy silane and methyl triethoxy silane. Specific examples of chloro silane include γ-chloropropyl trimethoxy silane. Specific examples of phenyl silane include phenyl trimethoxy silane.

Other polymers include, for example, block copolymer having at least one polymer block mainly composed of vinyl aromatic compound, and at least one polymer block composed of conjugate diene compound. They are block copolymers expressed in the formulas A-B; A-B-A; B-A-B-A; A-B-A-B-A, etc. (where A is polymer block mainly composed of thermoplastic vinyl aromatic compound, and B is polymer block mainly composed of conjugate diene compound having elastomer property, or hydrogen additive compound of the polymer block). Compounds mainly composed of vinyl aromatic compound constituting polymer block A include, for example, styrene, α-methyl styrene, vinyl toluene, and their mixtures. Conjugate diene compounds include, for example, butadiene, isoprene, 1,3-pentadiene, and their mixtures. Other polymers include, for example, ethylene/vinyl acetate, or its saponification product of ethylene/vinyl alcohol.

In the copolymer of polyolefin and unsaturated carboxylic acid, when ionomer blending metal compound is added, the adhesion strength to various materials may be improved outstandingly.

EXAMPLE

The invention is further described below by presenting an example.

Example 1

According to the embodiment (FIGS. 6A to 6C) described above, an ink jet recording head having a flexible wiring substrate was manufactured. In this example, MODIC-AP (Mitsubishi Chemical Corporation) mainly composed of polypropylene (melting point 140° C.) was used as the thermally fusible adhesive layer 237. Heating condition of heat tool was 200° C., 120 seconds.

EVALUATION

To evaluate the durability and printing quality of the ink jet recording head of Example 1, each ink jet recording head was filled with an ink of purified water/glycerin/direct black 154 (water soluble black dye)=65/30/5 (by mass), and stored for 2 months at 60° C. Test prints of A4 format were attempted in ink jet printing machine. As a result, there was no problem in printing quality. Oozing of ink into or from the adhesion region of flexible substrate of the ink jet recording head was not observed, and at the same time, there was no change in the fixing strength.

This application claims priority from Japanese Patent Application No. 2005-107646 filed Apr. 4, 2005, which is hereby incorporated by reference herein.

What is claimed is:

1. A liquid discharge head comprising:

a discharge element substrate including an orifice plate having a discharge port for discharging a liquid, and a supply port opened in the reverse side of the surface forming the discharge port for supplying a liquid into the discharge port;

a support member having a supply path for supplying a liquid into the supply port; and a flexible wiring substrate having a blanking portion for transmitting a signal for discharging a liquid to the discharge element substrate, wherein the discharge element substrate is electrically connected to the flexible wiring substrate on the surface opening the supply port, the flexible wiring substrate is bonded to both the discharge element substrate and the support member by means of an adhesive, and the end face of the blanking portion is covered with the adhesive, the covered blanking portion communicates with the supply port, and the adhesive is a thermally fusible adhesive composed of denatured polyolefin, having a softening point of 80° C. or higher.

2. The liquid discharge head according to claim 1, wherein the polyolefin is polypropylene.

3. A method for manufacturing a liquid discharge head comprising a discharge element substrate including an orifice plate having a discharge port for discharging a liquid, and a supply port opened in the reverse side of the surface forming the discharge port for supplying a liquid into the discharge port, a support member having a supply path for supplying a liquid into the supply port, and a flexible wiring substrate having a blanking portion for transmitting a signal for driving an energy generating element, the method comprising:

a step of laminating the flexible wiring substrate having a thermally fusible adhesive made of polyolefin or denatured polyolefin, having a softening point of 80° C. or higher, on the support member;

a step of laminating the discharge element substrate on the flexible wiring substrate so that the blanking portion and the supply port may communicate with each other; and a step of heating the adhesive, bonding the flexible wiring substrate to both the support member and the discharge element substrate, and covering the end face of blanking portion with the adhesive.

4. The method for manufacturing a liquid discharge head according to claim 3, wherein the polyolefin is polypropylene.

5. A liquid discharge head comprising:

a discharge element substrate including an orifice plate having a discharge port for discharging a liquid, and a supply port opened in the reverse side of the surface forming the discharge port for supplying a liquid into the discharge port;

a support member having a supply path for supplying a liquid into the supply port; and a flexible wiring substrate having a blanking portion for transmitting a signal for discharging a liquid to the discharge element substrate, wherein the discharge element substrate is electrically connected to the flexible wiring substrate on the surface opening the supply port, the flexible wiring substrate is bonded to both the discharge element substrate and the support member by means of an adhesive, and the end face of the blanking portion is covered with the adhesive, the covered blanking portion communicates with the supply port, and the adhesive is a thermally fusible adhesive composed of denatured polyolefin, having a softening point exceeding the maximum reaching temperature of discharge element substrate before discharge of liquid.

6. The liquid discharge head according to claim 5, wherein the orifice plate is formed of a cured material of photosensitive resin, and the softening point of the thermally fusible adhesive is lower than the softening temperature of the cured material.

* * * * *